US007623771B2

(12) United States Patent
Lentz et al.

(10) Patent No.: US 7,623,771 B2
(45) Date of Patent: Nov. 24, 2009

(54) DETECTION OF DEPOSITS IN STEAM HUMIDIFIERS

(75) Inventors: Tracy L. Lentz, Minneapolis, MN (US); Steven R. Hoglund, Minneapolis, MN (US)

(73) Assignee: Honeywell International Inc., Morristown, NJ (US)

( * ) Notice: Subject to any disclaimer, the term of this patent is extended or adjusted under 35 U.S.C. 154(b) by 316 days.

(21) Appl. No.: 11/767,835

(22) Filed: Jun. 25, 2007

(65) Prior Publication Data

US 2008/0317447 A1 Dec. 25, 2008

(51) Int. Cl.
*A01G 13/06* (2006.01)
*F24F 3/14* (2006.01)

(52) U.S. Cl. ..... 392/386; 392/402; 392/441

(58) Field of Classification Search ..... None
See application file for complete search history.

(56) References Cited

U.S. PATENT DOCUMENTS 3,660,635 A * 5/1972 Liebert ..... 392/387
4,675,505 A * 6/1987 Fischer ..... 392/326
4,705,936 A 11/1987 Fowler
4,841,122 A 6/1989 Marton
4,952,779 A * 8/1990 Eaton-Williams ..... 392/327
5,363,471 A * 11/1994 Jones ..... 392/325
5,440,668 A * 8/1995 Jones ..... 392/327
5,758,018 A * 5/1998 Fowler, Jr. ..... 392/402
6,078,729 A * 6/2000 Kopel ..... 392/402
2006/0027267 A1 * 2/2006 Fritze ..... 137/487.5

* cited by examiner

*Primary Examiner*—Thor S Campbell

(57) ABSTRACT

A humidifier configured to determine when the humidifier requires cleaning. The humidifier includes a tank for containing water, a heater for heating the water in the tank to generate steam, and one or more water level sensors for detecting the level of water in the tank, including detecting water at first level and a second level, where the first level is lower than the second level. The humidifier further includes a drain valve for draining water from the tank and a controller. The controller is configured to open the drain valve to drain water from the tank, measure a time interval required for the water to drain from the second level to the first level, and compare the time interval against a threshold value. If the time interval exceeds the threshold value, then the controller is configured to provide an indication to clean the humidifier. Methods are also disclosed.

22 Claims, 3 Drawing Sheets

DETECTION OF DEPOSITS IN STEAM HUMIDIFIERS

FIELD OF THE INVENTION

The invention relates to humidification systems. More particularly, the invention relates to steam humidifier systems and the detection of deposits and accumulations within a humidifier.

BACKGROUND OF THE INVENTION

The interior spaces of buildings are often at a lower than desired level of humidity. This situation occurs commonly in arid climates and during the heating season in cold climates. There are also instances in which special requirements exist for the humidity of interior spaces, such as in an art gallery or where other delicate items are stored, where it is desired that the interior humidity levels be increased above naturally occurring levels. Therefore, humidifier systems are often installed in buildings to increase the humidity of an interior space.

Humidification systems may take the form of free-standing units located within individual rooms of a building. More preferably, humidification systems are used with building heating, ventilation, and air conditioning (HVAC) systems to increase the humidity of air within ducts that is being supplied to interior building spaces. In this way, humidity can be added to the air stream at a centralized location, as opposed to having multiple devices that increase humidity at multiple points within the building interior. Additionally, because the air within ducts may be warmer than the interior space air during a heating cycle, the additional air temperature can help prevent water vapor from condensing in the vicinity of the humidifier, such as on the inside of the duct.

An issue associated with humidification system is that they should only discharge water vapor into a duct and not liquid water. Liquid water within a duct can create a number of serious problems. For example, liquid water that remains stagnant within a duct can promote the growth of mold or organisms that can release harmful substances into the air flow, potentially causing unhealthy conditions in the building. Liquid water can also cause rusting of a duct which can lead to duct failure, and can create leaks from the duct to the building interior spaces which are unsightly, can cause a slipping hazard, and can lead to water damage to the structure.

One known humidification method involves direct steam injection into an air duct of a building. This approach is most commonly used in commercial buildings where a steam boiler is present to provide a ready supply of pressurized steam. Steam humidification has the advantage of having a relatively low risk of liquid moisture entering a duct or other building space. However, pressurized steam injection systems are associated with a risk of explosion of the steam pressure vessels, as well as a risk of possibly burning nearby people, both of which are very serious safety concerns. In residential applications, there are usually no readily available sources of pressurized steam. An open bath humidifier system may be used, however these are difficult to install because they require a large hole in the duct and can only be used with horizontal or upflow ducts. Alternatively, a residential application may use direct steam injection, but this requires a separate unit to generate pressurized steam and this separate unit is costly. Moreover, the system would suffer from the same disadvantages as are present in commercial direct steam injection systems.

One type of humidifier that is commonly used in residential applications that has the advantages of steam humidification without the need for a separate source of pressurized steam is a tank heater type humidifier. In this type of humidifier, heat is generated within a tank of water, causing the water to boil and steam to be generated. The heat input may be any of a number of different sources, however, commonly an electrical heating element is used. One problem associated with this type of humidifier is that as water is boiled off as steam, the impurities in the water remain in the tank. These impurities generally include minerals that are naturally occurring in most sources of water. Over time, the concentration of these impurities will tend to increase in the tank, leading to greater amounts of impurities that solidify and deposit on the surfaces inside the tank. These deposits can accumulate to the point of creating numerous problems. For example, deposits on a heating coil reduce the heat transfer rate to the water, resulting in lower steam production and possibly causing overheating and failure of the coil. Deposits in the tank can clog passages where water or steam flows in or out, resulting in the failure of the humidifier.

Improved humidification systems are desired. In particular, improved techniques for detecting accumulation of deposits and obstructions within a humidifier are needed.

SUMMARY OF THE INVENTION

An aspect of the present disclosure relates to a humidifier configured to determine when the humidifier requires manual cleaning. The humidifier includes a tank for containing water, a heater for heating the water in the tank to generate steam, and one or more water level sensors for detecting the level of water in the tank, including detecting water at a first level and a second level, where the first level is lower than the second level. The humidifier further includes a drain valve for draining water from the tank and a controller. The controller is configured to open the drain valve to drain water from the tank, measure a time interval required for the water to drain from the second level to the first level, and compare the time interval against a threshold value. If the time interval exceeds the threshold value, then the controller is configured to provide an indication to clean the humidifier.

Another aspect of the invention relates to a method for determining whether a tank heater humidifier requires cleaning. The method includes providing a tank having a fill valve for filling the tank with water, a drain valve for draining water from the tank, and a heater for heating water in the tank to produce steam. The method further includes providing one or more sensors configured to detect the level of water in the tank at a first level and a second level, where the first level is lower than the second level. The method also includes the steps of determining whether water is at the second level in the tank of the humidifier, and if not, opening a fill valve until water is at the second level, opening the drain valve, and starting a timer measurement when the water falls below the second level in the tank and stopping the timer measurement when the water falls below the first level in the tank. Lastly, the method includes the step of determining whether the humidifier requires cleaning based on the timer measurement.

The invention may be more completely understood by considering the detailed description of various embodiments of the invention that follows in connection with the accompanying drawings.

Figure 1:
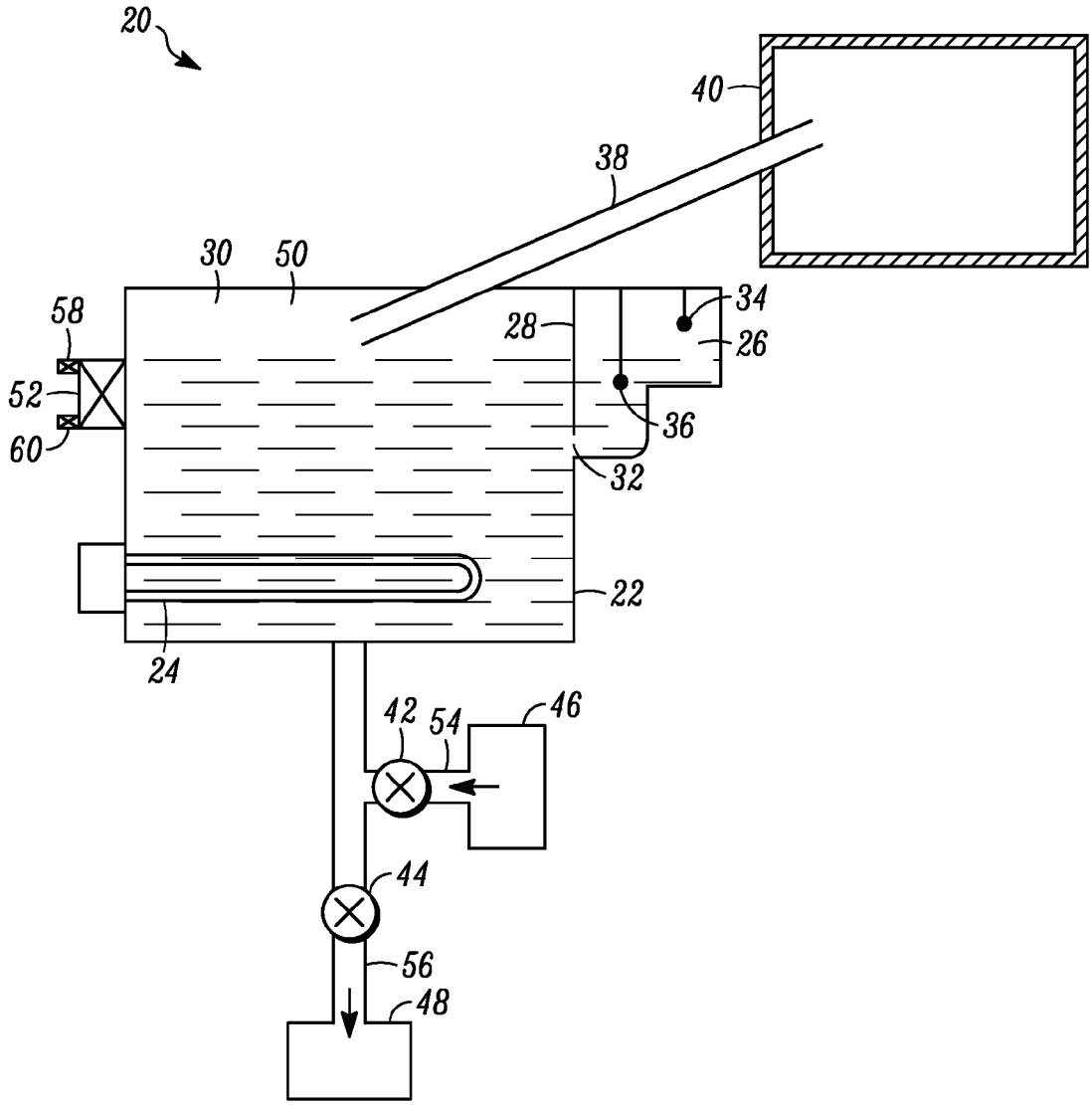
FIG. 1 is a cross-sectional view of a tank heater type steam humidifier constructed according to the principles of the present invention.

While the invention may be modified in many ways, specifics have been shown by way of example in the drawings and will be described in detail. It should be understood, however, that the intention is not to limit the invention to the particular embodiments described. On the contrary, the intention is to cover all modifications, equivalents, and alternatives following within the scope and spirit of the invention as defined by the claims.

DETAILED DESCRIPTION OF THE INVENTION

As described above, minerals, sediments, and other impurities present in water tend to deposit in the tank of a tank heater type humidifier over the course of its operation. These deposits can build up and cause damage and interfere with the proper functioning of the humidifier. However, the rate at which these deposits form depend on a number of variables, including the mineral content of the water (hardness) and the amount of time that the humidifier is operated. In some cases, it is recommended that the user of a humidifier disassemble and manually clean the tank and associated parts at a regular interval, such as every year. This strategy, however, fails to account for the variability in the rate at which deposits form, such that in some cases the tank is cleaned more often than it needs to be, and in others, the tank is not cleaned often enough and consequently the humidifier fails. This strategy also is dependent upon the user actually cleaning the tank, which in many cases is not a reliable assumption, particularly if the user finds it difficult to predict when the tank needs to be cleaned.

One approach used to minimize the amount of cleaning required or to extend the intervals between cleanings is to utilize a regular flush and fill cycle. For example, in one embodiment, the humidifier may be configured to drain the tank once every 30 hours and then refill with fresh water. This technique helps to remove the relatively greater concentration of contaminants that will be present in the tank after a period of operation, and thereby slows down the rate of impurity deposition on the internal surface. Other time intervals may also be used.

Regardless, though, of whether the tank is drained and filled at regular intervals, deposits will still form on internal surfaces of the humidifier. One of the problems with this is that these deposits can clog the drain, either reducing the efficiency of the drain or preventing the tank from draining all together. When this occurs, cascading failures tend to occur where the concentration of contaminants increases in the tank by virtue of the fact that the tank drain is obstructed, thereby increasing the rate of deposit on the surfaces within the tank and ultimately causing functional failure, such as failure of the heating coil. Furthermore, deposits can also form in the inlet to the tank, which tend to increase the fill time and therefore decrease the capacity of the humidifier to satisfy a demand for humidification. Furthermore, if the deposits prevent the tank from being adequately replenished with water, the water level may drop below the level of the heating element. If the heating element is energized without being submerged in water, typically the heating element will overheat and burn out. It is therefore desirable to be able to detect when the accumulated deposits are interfering with the ability of the tank drain and inlet to function properly.

An embodiment of a tank heater type humidifier is depicted in FIG. 1. Humidifier 20 includes a tank 22 configured to retain a volume of liquid water. Tank 22 is generally constructed out of material that is sufficiently resistant to high temperatures, such as the temperature of boiling water. Examples of suitable materials for tank 22 are temperature resistant plastics, an example of which is a thermoplastic resin such as a polyphenylene ether/polystyrene blend, and stainless steel. A heating coil 24 is also provided to heat water within tank 22. Heating coil 24 is generally an electric heating coil that generates heat when an electric current is passed through a resistive material. However, other types of heating coils 24 are usable. For example, heating coil 24 could pass a heated material such as a heated liquid through a tube that allows heat to transfer to the liquid in the tank 22. Furthermore, a heater may be substituted for heating coil 24, where a heater is of a conventional liquid heating design, such as a propane or natural gas liquid heater or a fuel oil burner.

Tank 22 is shown in FIG. 1 as having an isolated chamber 26 that is separated from a main chamber 30 of tank 22 by baffle 28. Isolated chamber 26 is in fluid communication with main chamber 30 by way of opening 32 which allows liquid from main chamber 30 to flow into isolated chamber 26 and to reach the same fluid level as in main chamber 30. Isolated chamber 26 tends to be insulated from ripples, bubbles, and other fluctuations of the water level in main chamber 30. FIG. 1 also shows that a high level water sensor 34 and a low level water sensor 36 are present within isolated chamber 26. Sensor 36 detects the presence of water at a first level and sensor 34 detects the presence of water at a second level, where the first level is lower than the second level. Each of sensors 34, 36 is configured to detect the presence of water at the particular sensor. Sensors 34, 36 may be a current-detection type of sensor, where a source of current such as alternating current is applied at a point in the tank that is below both sensors 34, 36 and where sensors 34, 36 are configured to detect the presence of current which indicates a current path from the source of current, through the water, to sensors 34, 36. Alternatively, high level and low level sensors 34, 36 may be replaced by a single water level sensor that produces a signal representative of the level of the water in tank 22, such as a float sensor. Humidifier 20 further includes a tube 38 that projects from main tank chamber 30 to the interior of an air duct 40 and that provides a fluid connection for the flow of steam from main tank chamber 30 to the interior of air duct 40.

Humidifier 20 includes a fill valve 42 and a drain valve 44. Fill valve 42 is in fluid communication through conduit 54 with a water supply 46, such as a municipal water supply system or a well pump system. Drain valve 44 is in fluid communication through a conduit 56 with a water receiving system 48, such as a municipal water treatment system, a septic system, or a drain field. Humidifier 20 further includes a controller 52 that is in communication with water level sensors 34, 36 and has the ability to control the fill and drain valves 42, 44. Controller 52 also includes one or more timers configured to measure elapsed times.

Figure 2:
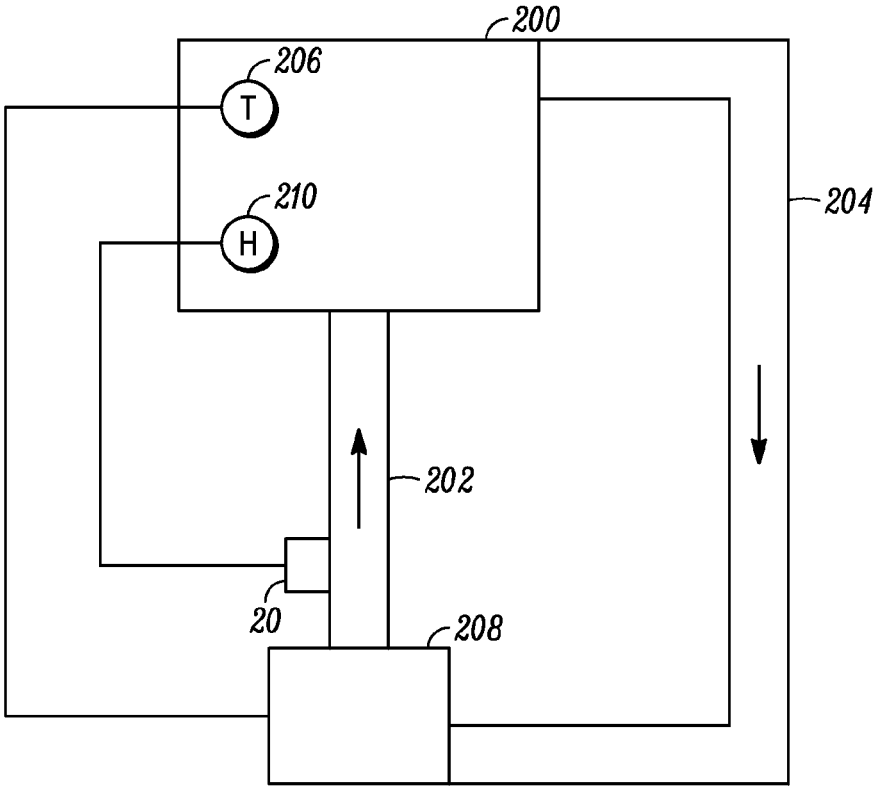
FIG. 2 is a schematic representation of a HVAC system having a humidifier.

A typical heating, ventilation, and air conditioning (HVAC) installation that includes a humidifier is depicted in FIG. 2. Conditioned space 200 of a building is configured to receive conditioned air from supply duct 202 and to provide for return air flow through return duct 204. Conditioned space 200 includes at least one thermostat 206 that is in communication with conditioning device 208. Conditioning device 208 may be a furnace, a boiler, an air conditioner, a heat exchanger, or a combination thereof, that is configured to condition return air from return duct 204 and deliver the conditioned air to supply duct 202. Conditioning air may involve increasing the temperature of the air, decreasing the temperature of the air, cleaning the air, or other such processes. Conditioning device 208 generally includes a fan or blower for drawing air from return duct 204 and delivering air through supply duct 202. Thermostat 206 senses the temperature in conditioned space 200 and activates conditioning device 208 when the temperature deviates from a set value. When conditioning device 208 is activated by a call for conditioning from thermostat 206, conditioned air is supplied through supply duct 202 to adjust the temperature of conditioned space 200 until the temperature sensed by thermostat 206 satisfies a set value. In some embodiments, thermostat 206 may be configured to receive an input to run a fan or blower without temperature conditioning of the air. In this case only the fan or blower portion of conditioning device 208 is activated and air is supplied through supply duct 202 without being conditioned by conditioning device 208.

FIG. 2 also shows a typical installation of humidifier 20. Humidifier 20 is installed on supply duct 202 downstream of conditioning device 208. A humidistat 210 is installed in conditioned space 200 or within return duct 204 and is in communication with humidifier 20. One embodiment of a humidistat 210 senses the relative humidity level (RH) present in conditioned space 200 and activates humidifier 20 when the humidity level falls below a set value. Other embodiments of humidistat 210 sense indoor dewpoint or even outdoor dewpoint in combination with either indoor RH or indoor dewpoint. In some embodiments, the thermostat 206 will incorporate the functionality of humidistat 210. When humidifier 20 is activated, humidity is added to conditioned air within supply duct 202 in order to increase the humidity in conditioned space 200. In some embodiments, humidifier 20 and/or humidistat 210 are configured to activate humidifier 20 only when conditioning device 208 is activated. This ensures that air is flowing through supply duct 202 to carry the additional humidity to conditioned space 200. If humidifier 20 is activated without air flowing in supply duct 202, the additional humidity provided by the humidifier may condense on the walls of the duct and cause damage, and the additional humidity will also not be effectively delivered to conditioned space 200. In other embodiments, the conditioning device 208 will be activated any time there is a demand for humidification from humidistat 210.

In operation of humidifier 20, when there is a call for humidification, humidifier 20 is filled by opening fill valve 42 to allow water from supply 46 to flow through conduit 54 into main chamber 30 of tank 22 and to isolated chamber 26. Fill valve 42 will remain open until water is detected at high water sensor 34, at which point fill valve 42 is closed. Heating coil 24 is then energized, causing the temperature of the water in tank 22 to increase in temperature. In some embodiments, water tank 22 is filled prior to there being a demand for humidification, such as at installation or system start-up, and then waits for a call for humidification to energize the heating coil 24. As the water in tank 22 is heated, the water in tank 22 will begin to boil and steam will form at the top 50 of tank 22. A very slight pressure will be established in the top area 50 of tank 22, driving steam through tube 38 and into duct 40. Tube 38 is configured to allow sufficient steam to flow into duct 40 that very little pressure will build in tank 22. In other embodiments, no pressure builds in tank 22 and steam is carried by convection into duct 40. The steam enters the air in duct 40 where it is carried to conditioned spaces within a building.

As water is converted to steam, the water level in tank 22 will decrease. With sufficient operation, the water level will drop below the height of low water sensor 36. So long as there is still a demand for humidification, when water falls below the height of low level sensor 36, fill valve 42 will be opened and remain open until water reaches high level sensor 34.

Controller 52 also includes settings to control a regular drain cycle. For example, controller 52 may have a drain cycle time setting, $T_{DC}$, that is configured to initiate a drain cycle every 24 or 48 hours of elapsed time, or alternatively, could be configured to initiate a drain cycle every 10, 15, or 20 hours of operating time. Elapsed time is a measurement of real time since the tank 22 has been filled, and operating time is a measurement of the amount of time that the heating coil 24 is energized to create steam. Other time intervals are equally usable and are set according to the desired performance of the humidifier 20, the quality of the water being used, or other considerations. When a drain cycle is initiated, heating coil 24 is de-energized and drain valve 44 is opened to allow water from tank 22 to flow under the force of gravity through drain valve 44 and conduit 56 to water receiving system 48. In some embodiments, before drain valve 44 is opened, fill valve 42 is opened to fill tank 22 to high level sensor 34. Then the fill valve 42 is turned off after water level reaches the high level sensor 34. This allows the drain cycle to start from a known water level in tank 22.

In some embodiments, the drain valve is kept open a set amount of time (estimated complete drain time, $T_{ECD}$) that would ordinarily be expected to allow all of the water in tank 22 to drain completely. For example, a setting such as 3.5 minutes may be programmed into controller 52 based on the expected drainage of tank 22, where the amount of time is a function of the tank size, the restriction in drain valve 44 and conduit 56, and any other factors affecting the amount of time for the tank to drain under normal circumstances. In other embodiments, $T_{ECD}$ may be estimated by controller 52 based on how long it takes the water to drop from the high level sensor to the low level sensor. In some embodiments, the fill valve 42 is kept open while drain valve 44 is open to provide additional flushing and cleaning of the valve and tank. However, generally water will flow at a greater rate through drain valve 44 than through fill valve 42, and therefore the tank 22 will typically drain despite fill valve 42 being open.

After $T_{ECD}$ elapses, drain valve 44 is closed and, if fill valve 42 is not open, then fill valve 42 is opened. In some embodiments, there is no water sensor at the bottom of tank 22, such that it is not possible to determine whether tank 22 drains completely, so $T_{ECD}$ is used to determine when to refill. In some embodiments, $T_{ECD}$ may be approximately 1 to 3 minutes, and in other embodiments $T_{ECD}$ may be 1 to 6 minutes. However, other time intervals are equally usable and are based on the design and configuration of the particular humidifier. Then water enters tank 22 and fill valve 42 is kept open until water reaches high level sensor 34.

Deposits, sediment, and other obstructions present in the tank 22 or drain valve 44 can be detected by measuring time intervals when the tank 22 is being filled. One time that can be measured is the time $T_{FL}$ from when the drain valve 44 is closed and the fill valve 42 is open to the time that the water reaches the low level sensor 36, or alternatively, the time that the water reaches the high level sensor 34. If this time is too short, it indicates that the tank 22 did not drain completely during the drain cycle, such that when the fill valve 42 was opened the tank was already partially filled. This situation is likely the result of the accumulation of deposits within the tank drain. It should be noted, however, that a predictable fill rate of water increases the accuracy of methods that use filling times to indicate the need for cleaning.

The condition of the drain can also be determined by measuring the time interval during a draining cycle between the high level sensor 34 being uncovered to the time of the low level sensor 36 being uncovered. If this time is too long, this is an indication that the drain is clogged or partially clogged. In addition, if after drain valve 44 is opened and estimated complete drain time $T_{ECD}$ has elapsed there is still water in contact with low level sensor 36 (or high level sensor 34), then this is an indication that the drain is clogged or partially clogged.

Figure 3:
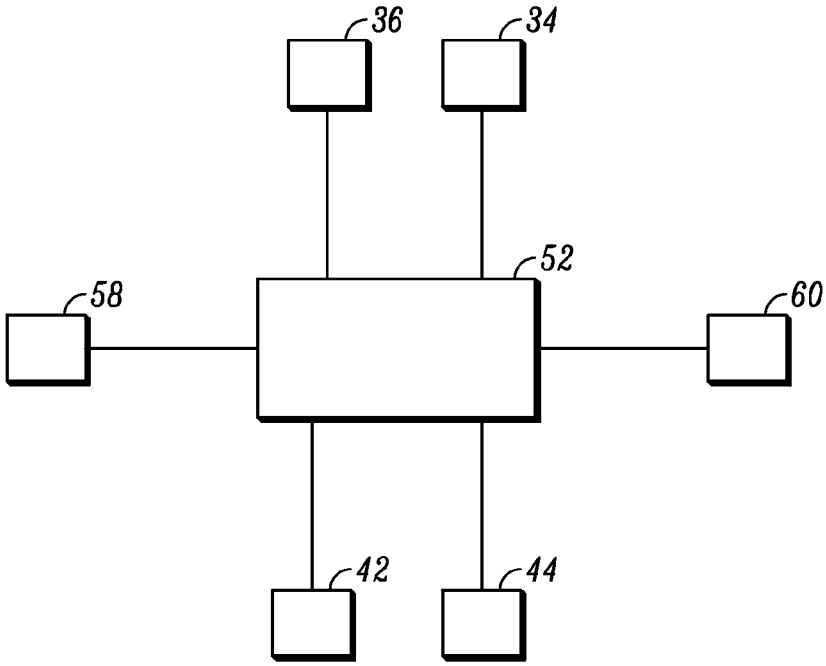
FIG. 3 is a schematic representation of a control system of a humidifier.

An embodiment of the components of a control system of humidifier 20 are depicted in FIG. 3. As shown in FIG. 3, controller 52 is in communication with high level sensor 34 and low level sensor 36. Controller 52 therefore receives signals representative of whether the water level in tank 22 is at or above low level sensor 36 and whether the water level in the tank 22 is at or above high level sensor 34. Controller 52 is further in communication with fill valve 42 and drain valve 44, and is able to control the operation of each. Controller 52 is also shown in FIG. 3 as being in communication with indicator 58. Indicator 58 is configured to provide an indication of the need to clean the humidifier. For example, indicator 58 may be an audible tone producer that produces a sound indicative of the need to clean the humidifier, or it may be a light or other display that is energized to indicate the need to clean the humidifier. Controller 52 includes the ability to measure elapsed times, including the elapsed time since the most recent drain cycle, the elapsed time during a drain cycle between the water uncovering the high level sensor 34 and the low level sensor 36, and the elapsed time during a fill cycle from the fill valve being open and the drain valve being closed to the water covering the low level sensor 36. Controller 52 further includes memory to store various parameters, such as a drain cycle interval setting and threshold values for the drain cycle and fill cycle elapsed times. Controller 52 also has a switch or button 60 configured to receive input from a user to indicate that the humidifier has been cleaned.

The controller 52 is configured to determine whether the humidifier needs to be cleaned according to the procedure set forth above. However, in order to determine if the drain time or fill time measurements indicate a need to clean the humidifier, it is necessary to define one or more threshold values, such that measurements that deviate from the threshold are judged to be indicative of the need to clean the humidifier. For example, a threshold may be established for the tank drain time, $T_{DC}$, where drain times in excess of the threshold are used to indicate the need to clean the humidifier. Similarly, a threshold may be established for the tank fill time, $T_{FL}$, where a fill time that is less than the threshold is used to indicate the need to clean the humidifier. In some cases, the threshold value or values can be set by testing in a controlled environment, such as a laboratory, where a range of anticipated operating conditions can be varied, such as inlet water pressure and outlet flow restrictions. The normal range of fill and drain times can be determined, and then reasonable judgment can be exercised to determine a threshold value for the amount of time that is indicative of a need to clean the humidifier. In some other cases, a reference or baseline value may be established at the time that the humidifier is installed. This technique has the advantage that it takes into account variables unique to the particular installation, such as the supply water pressure and any outlet flow restrictions. The humidifier may be configured with a special switch or protocol for the installer to cycle the humidifier through a fill and drain cycle. Because the humidifier is new at this point and there are no deposits in it, the fill and drain cycle time measurements made during this test cycle are representative of the operation of the humidifier in a state where it does not need to be cleaned. The controller 52 may then include an algorithm or a value for modifying the measured fill and drain cycle times to produce a threshold value or values. For example, the controller 52 may take the measured drain cycle time and add a set time to determine a threshold value, and may take the measured fill cycle time and subtract a set time to determine a threshold value. Alternatively, the controller 52 may take the measured drain cycle time and increase it a certain percentage to determine a threshold value and may take the measured fill cycle time and decrease it a certain percentage to determine a threshold value. Other techniques are usable to determine threshold values.

In use, a measured drain cycle time, fill cycle time, or various combinations thereof, are compared against the corresponding threshold values to determine if there is a problem such that the humidifier requires cleaning. Generally, measured drain cycle times that exceed a corresponding threshold value and measured fill cycle times that are less than a corresponding threshold value are each indicative of the need to clean the humidifier.

The controller may be programmed to initiate a response if a threshold value is met or exceeded. For example, the controller 52 may initiate an audible signal that is indicative of the need to clean the humidifier. Likewise, the controller 52 may initiate a visual signal such as a light or a message that is indicative of the need to clean the humidifier. There are many other usable embodiments for indicating the need to clean the humidifier. In some embodiments, the controller 52 is configured to turn off, or otherwise not utilize the humidifier, until the humidifier has been cleaned. In this case, the controller 52 needs to have some way to receive input that the humidifier has been cleaned. An example is a button or a switch 60 or other form of input that allows the user to provide an indication that the humidifier has been cleaned and is ready for continued operation. In other embodiments, the controller 52 is configured to continue to operate the humidifier after providing an indication of the need to clean the humidifier.

Figure 4:
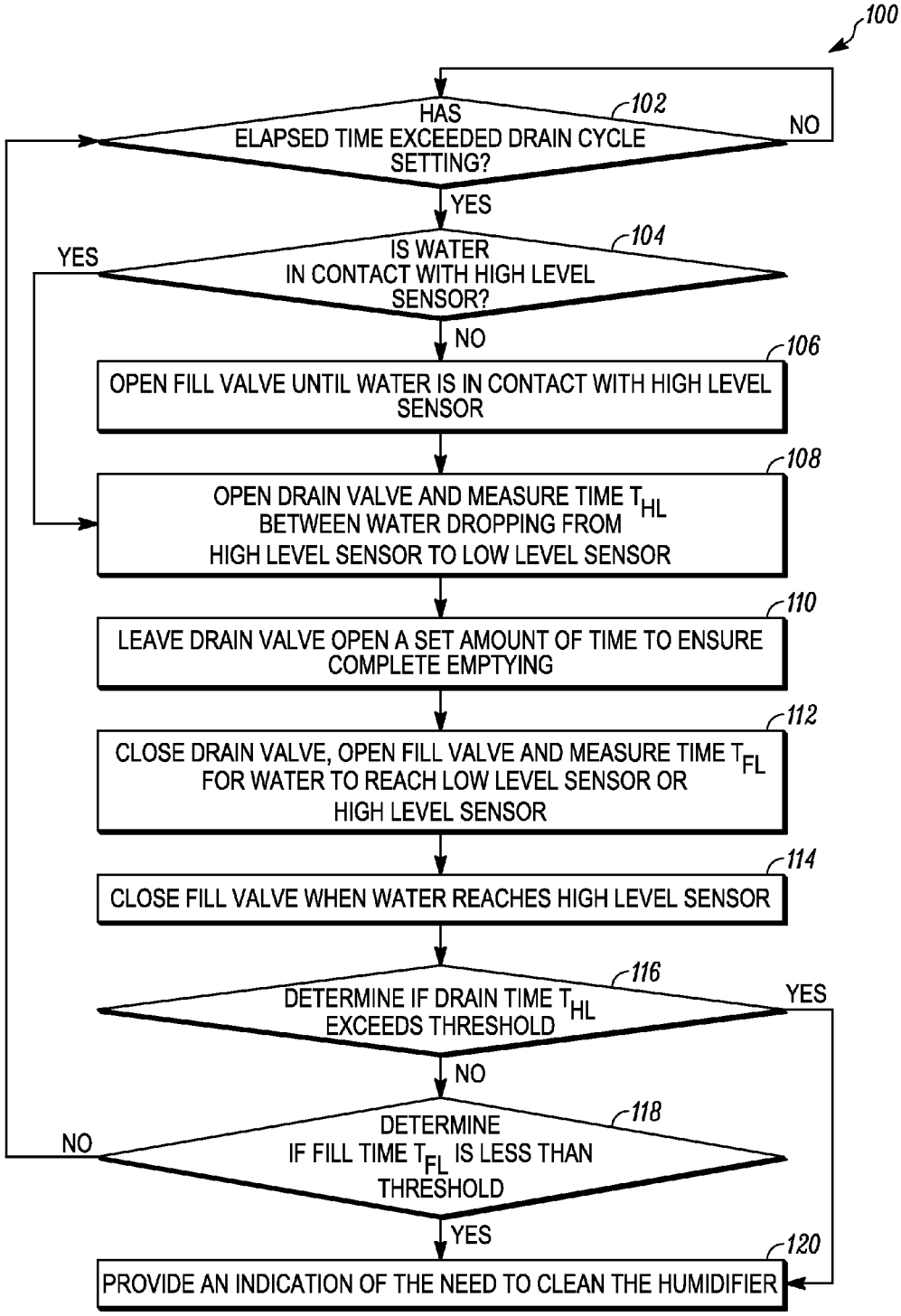
FIG. 4 is a flow chart depicting steps for determining whether a humidifier needs to be cleaned.

A flow chart of an embodiment of an algorithm for detecting an obstructed drain in a tank heater type humidifier is depicted in FIG. 4. Obstruction detection algorithm 100 begins at step 102 with determining whether the drain cycle time setting, $T_{DC}$, stored in the controller 52 has been met or exceeded. If not, then the system waits until the drain cycle setting has been met or exceeded. However, once the drain cycle interval setting has been met or exceeded, then the controller 52 determines at step 104 whether water is in contact with the high level sensor 34. If not, then at step 106 the controller opens fill valve 42 until water is in contact with the high level sensor 34. Next, at step 108 controller 52 opens the drain valve 44 and measures the amount of time, $T_{HL}$, it takes for the water to drop from the high level sensor 34 to the low level sensor 36. At step 110, the controller leaves the drain valve 44 open a set amount of time, $T_{ECD}$, in which it would ordinarily be expected that all the water from tank 22 would drain out. In some embodiments, the fill valve 42 is opened during at least part of the time $T_{ECD}$ when the tank is draining to assist with flushing deposits from the tank 22 and drain valve 44. Then at step 112, controller 52 closes the drain valve 44 and opens the fill valve 42 and measures the amount of time, $T_{FL}$, it takes for the water to rise to the low level sensor 36 after the fill valve is opened and the drain valve is closed. At step 114, when the water reaches the high level sensor 34, the controller 52 closes the fill valve 42. Step 116 involves comparing the measured drain time from the high level sensor 34 to the low level sensor 36, $T_{HL}$, to a threshold value. Step 118 involves comparing the measured fill time from the fill valve opening to the water reaching the low level sensor 36, $T_{FL}$, to a corresponding threshold value. If the measured drain time $T_{HL}$ does not exceed the corresponding threshold and the measured fill time $T_{FL}$ is not less than the corresponding threshold, then the algorithm returns to step 102 to wait for the appropriate drain cycle interval. However, if either of the measured times deviates from the corresponding threshold, then at step 118, controller 52 provides an indication of the need to clean the humidifier. For example, this may include utilizing indicator 58 to provide an indication to the user at step 120. Where the measured drain or fill times deviate from the corresponding threshold or thresholds, in some embodiments, the humidifier is not used until it is properly cleaned, and in other embodiments, the humidifier continues to be used after the indication is provided at step 120.

Alternative embodiments of the algorithm depicted in FIG. 4 are usable. For example, in one usable embodiment, only the drain cycle time is measured and compared against a threshold. In another usable embodiment, only the fill cycle time is measured and compared against a threshold. Other combinations are usable.

The present invention should not be considered limited to the particular examples described above, but rather should be understood to cover all aspects of the invention as fairly set out in the attached claims. Various modifications, equivalent processes, as well as numerous structures to which the present invention may be applicable will be readily apparent to those of skill in the art to which the present invention is directed upon review of the present specification. The claims are intended to cover such modifications and devices.

The above specification provides a complete description of the structure and use of the invention. Since many of the embodiments of the invention can be made without parting from the spirit and scope of the invention, the invention resides in the claims.

What is claimed is:

1. A humidifier comprising:

(i) a tank for containing water;

(ii) a heater for heating the water in the tank to generate steam;

(iii) one or more water level sensors for detecting the level of water in the tank, including detecting water at a first level and a second level, where the first level is lower than the second level;

(iv) a drain valve for draining water from the tank; and (v) a controller configured to (a) open the drain valve to drain water from the tank;

(b) measure a time interval required for the water to drain from the second level to the first level; and (c) compare the time interval against a threshold value, and if the time interval exceeds the threshold value, provide an indication to clean the humidifier.

2. The humidifier of claim 1, further comprising a user input for providing an indication that the humidifier has been cleaned.

3. The humidifier of claim 2, where the controller is further configured to disable the heater between providing the indication to clean the humidifier and the user input indicating that the humidifier has been cleaned.

4. The humidifier of claim 1, further comprising a fill valve for filling the tank with water.

5. The humidifier of claim 4, where the controller is further configured to:

(i) close the drain valve at a specified time interval after the drain valve is opened;

(ii) open the fill valve;

(iii) measure a second time interval for the water to fill to one of the one or more water level sensors; and (iv) compare the second time interval against a second threshold value, and if the second time interval exceeds the second threshold value, provide an indication to clean the humidifier.

6. The humidifier of claim 1, where the indication is an audible indication.

7. The humidifier of claim 1, where the indication is a visually perceptible indication.

8. The humidifier of claim 1, further comprising a tube for transferring steam from the tank to a duct.

9. The humidifier of claim 1, where the heater comprises an electric resistance heater.

10. The humidifier of claim 4, where the drain valve and the inlet valve are each located below the bottom of the tank.

11. A method for determining whether a tank heater humidifier requires cleaning, the method comprising:

(i) providing a tank having a fill valve for filling the tank with water, a drain valve for draining water from the tank, and a heater for heating water in the tank to produce steam;

(ii) providing one or more sensors configured to detect the level of water in the tank, the one or more sensors being configured to detect water at a first level and a second level, where the first level is lower than the second level;

(iii) determining whether water is at the second level in the tank of the humidifier, and if not, opening a fill valve until water is at the second level;

(iv) opening the drain valve;

(v) starting a timer measurement when the water falls below the second level in the tank and stopping the timer measurement when the water falls below the first level in the tank; and (vi) determining whether the humidifier requires cleaning based on the timer measurement.

12. The method of claim 11, further comprising providing an indication of the need to clean the humidifier when it has been determined that the humidifier requires cleaning.

13. The method of claim 12, where the indication is an audible indication.

14. The method of claim 12, where the indication is a visually perceptible indication.

15. The method of claim 12, further comprising providing a user input for providing an indication that the humidifier has been cleaned.

16. The method of claim 15, further comprising disabling the heater after it has been determined that the humidifier requires cleaning and before receiving user input indicating that the humidifier has been cleaned.

17. The method of claim 11, further comprising the steps of:

(i) closing the drain valve at a set time interval after the drain valve is opened;

(ii) opening the fill valve and starting a second timer measurement;

(iii) stopping the second timer measurement when the water reaches one of the one or more water level sensors; and (iv) determining whether the tank requires cleaning based on the second timer measurement.

18. The method of claim 17, where the fill valve is closed when the water reaches the second level in the tank.

19. The method of claim 11, where the drain valve and the fill valve are each located below the bottom of the tank.

20. The method of claim 11, further comprising the steps of:

(i) determining a threshold value by:

(a) opening the drain valve when the humidifier is in a clean condition;

(b) starting a reference timer measurement when the water falls below the second level in the tank and stopping the reference timer measurement when the water falls below the first level in the tank; and (c) adjusting the reference timer measurement to create a threshold value; and (ii) determining whether the humidifier requires cleaning by comparing the timer measurement to the threshold value.

21. The method of claim 20, where the reference timer measurement is adjusted by a defined amount to create the threshold value.

22. The method of claim 20, where the reference timer measurement is adjusted by a multiplier to create the threshold value.

* * * * *